US007104902B2

(12) United States Patent
Dopson

(10) Patent No.: US 7,104,902 B2
(45) Date of Patent: Sep. 12, 2006

(54) THROW AND CATCH GAME AND METHOD OF PLAYING SAME

(76) Inventor: Roy Dopson, P.O. Box 616, Cudworth (CA) S0K 1B0

( * ) Notice: Subject to any disclaimer, the term of this patent is extended or adjusted under 35 U.S.C. 154(b) by 35 days.

(21) Appl. No.: 10/983,796

(22) Filed: Nov. 8, 2004

(65) Prior Publication Data

US 2005/0107191 A1 May 19, 2005

(30) Foreign Application Priority Data

Nov. 7, 2003 (CA) ..... 2448582

(51) Int. Cl.
*A63B 67/00* (2006.01)
*A63B 67/02* (2006.01)

(52) U.S. Cl. ..... 473/465; 473/415

(58) Field of Classification Search ..... 473/465, 473/468, 415; 273/126 R, 440; 446/48
See application file for complete search history.

(56) References Cited

U.S. PATENT DOCUMENTS 3,673,732 A * 7/1972 Liotta ..... 446/46
4,915,661 A * 4/1990 Getgey ..... 446/48
5,303,931 A * 4/1994 Brown ..... 273/348
5,575,483 A * 11/1996 Dineen et al. ..... 273/317.2

OTHER PUBLICATIONS

How to Play Jacks; eHow.com.*
Other Flying Disc Sports; of particular interested is: Maximum Time Aloft (MTA) and Throw, Run and Catch (TRC); Australian Flying Disc Association Inc. (AFDA).*

* cited by examiner

*Primary Examiner*—Mitra Aryanpour
(74) *Attorney, Agent, or Firm*—Frost Brown Todd LLC

(57) ABSTRACT

A throwing and catching game makes use of a series of pylons known as poles that operate analogously to a hole in the game of golf. In the course of play, a player advances the ball, or other throwing object, by throwing the object or the ball in the air and catching the object or the ball. The point at which a ball is successfully caught becomes the point where a subsequent throw is made. By a series of successful turns comprising throw and catch combinations, a player advances towards a pole. A pole is considered completed when the player, after having made a successful throw and catch, is able to touch the pole, while keeping at least one foot fixed at the point where the catch was made. Either a player alone, or a plurality of players in groups may play the game.

9 Claims, 2 Drawing Sheets

THROW AND CATCH GAME AND METHOD OF PLAYING SAME

This invention is in the field of games and in particular to novel games involving catching and throwing.

BACKGROUND OF THE INVENTION

The art of games is continually receptive to novel ways in which to use play as a constructive way in which to use recreational free time. In order to appeal to those interested in games, novel combinations of activities are used to create games that appeal to persons looking for new recreational activities. Games that involve physical exertion have the added benefit of promoting physical activity as well as the development of athletic skills.

Games to improve physical fitness and athletic coordination are common. Such games typically involve various combinations of running, throwing, catching, kicking or striking playing balls. These same skills are important for the enjoyment and development of proficiency in widely recognized sports such as football, baseball, ice hockey, soccer, tennis or badminton to name a few. Thus many aspects of games and activities that people engage in are also useful for developing physical skills that form the basis for subsequent development of more specialized athletic abilities.

Of all the basic physical skills, the development of hand-eye coordination required for throwing and catching is important to the successful participation in many formal sports. While there are many prior art devices and games that incorporate the actions of throwing and catching, the prior art games routinely require two or more players throwing to each other. The primary drawback of the prior art games is that they are not suitable for play by a single person. As a result, individuals often do not engage in active play involving throwing and catching on account of the lack of a playing partner.

SUMMARY OF THE INVENTION

The present invention has been made in view of the foregoing disadvantages of the prior art. Accordingly, it is an object of the present invention to provide a throwing and catching game playable by a single player.

It is a further object of the present invention to provide a throwing and catching game playable by a group of players.

It is a further object of the present invention to provide a throwing and catching game that creates interest for players by incorporating the sequence of play and scoring methods of the game of golf.

It is still another object of the present invention to provide a throwing and catching game that is adaptable to players of differing age and skill levels.

It is a further object of the present invention to provide a throwing and catching game that may be played indoors or outdoors, and which is portable and easily adaptable to any area of play, and which can be varied to suit the preferences of the player or players.

The throwing and catching game makes use of a series of pylons known as poles. Poles operate analogously to a hole in the game of golf. In the course of play, a player advances the ball, or other game piece, by throwing the object or the ball in the air and catching the object or the ball. The point at which a ball is successfully caught becomes the point where a subsequent throw is made. By a series of successful throw and catch combinations, a player advances towards a pole. A pole is considered completed when the player, after having made a successful throw and catch, is able to touch the pole with the ball, while keeping at least one foot fixed at the point where the catch was made. Either a player alone, or a plurality of players in groups may play the game. As with the game of golf, a group of four is considered preferable, but any number of players could conceivably participate.

Conveniently the apparatus of the invention comprises a starting mat or mark and 9 pylons, which are termed poles, and which are analogous to holes in golf. Alternatively, the starting point could comprise another pylon. In addition to the pylons, the apparatus of the invention also comprises at least one game piece, preferably a ball. The positioning of the game apparatus is easily modified for indoor or outdoor. In addition, other variations of the game apparatus could include differing sizes and types of balls, as well as devices for catching balls, such as a glove. Balls suitable for indoor or outdoor play could also be readily utilized within the rules of the game.

The invention provides a method of playing a throwing and catching game comprising providing a course comprising a plurality of poles, each pole comprising a starting mark and a pylon separated by a pole distance, wherein the poles are arranged sequentially such that a player can conveniently move from one pole to the starting mark of the next pole; providing a throwing object, and wherein a turn comprises standing at a throw location and throwing the throwing object towards the pylon corresponding to the pole being played, and a successful turn comprises moving to a catch location and catching the throwing object before the throwing object contacts the ground, and an unsuccessful turn comprises moving to a catch location and failing to catch the throwing object before the throwing object contacts the ground; playing each pole sequentially by standing at a first throw location corresponding to a starting mark for the pole, and taking successive turns and wherein for a successful turn the throw location for the next turn corresponds to the catch location of the successful previous turn, and wherein for an unsuccessful turn the throw location for the next turn corresponds to the throw location of the unsuccessful previous turn; wherein a pole is completed when a player located at the catch location of a successful turn is able to touch the pylon of the pole being played, and a score for the completed pole comprises the number of throws taken to complete the pole being played; and adding the scores for each pole to obtain a total score. The number of throws then equals the total of the number of successful turns and the number of unsuccessful turns.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
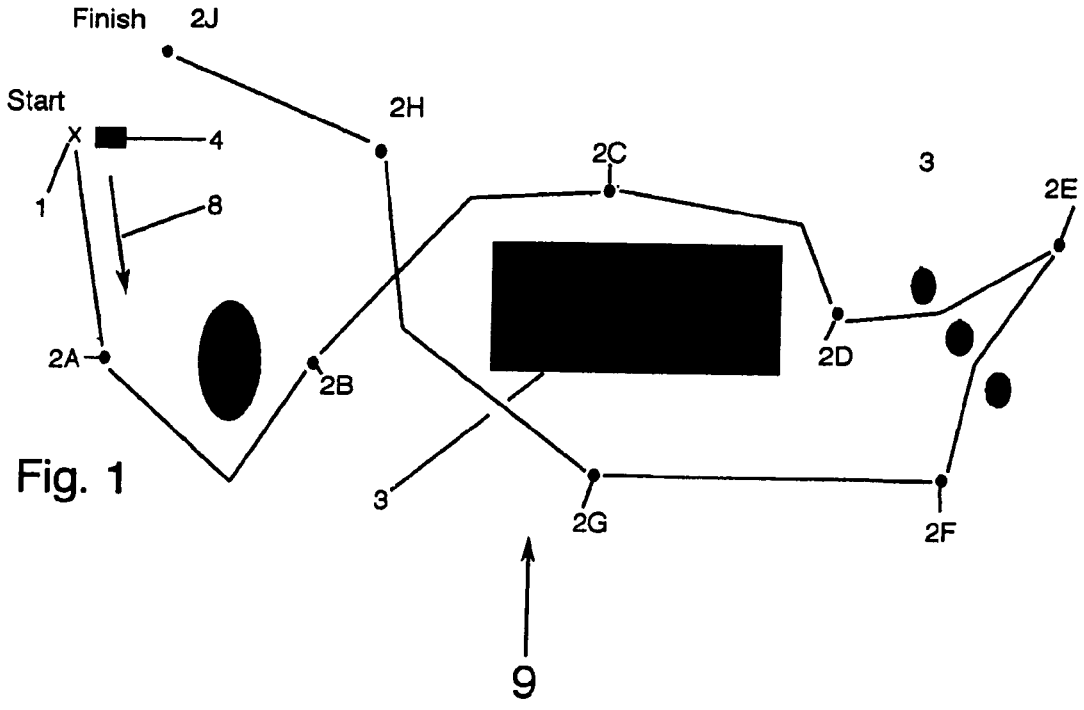
FIG. 1 is a schematic view of an example area of play of the game of the invention
Figure 2:
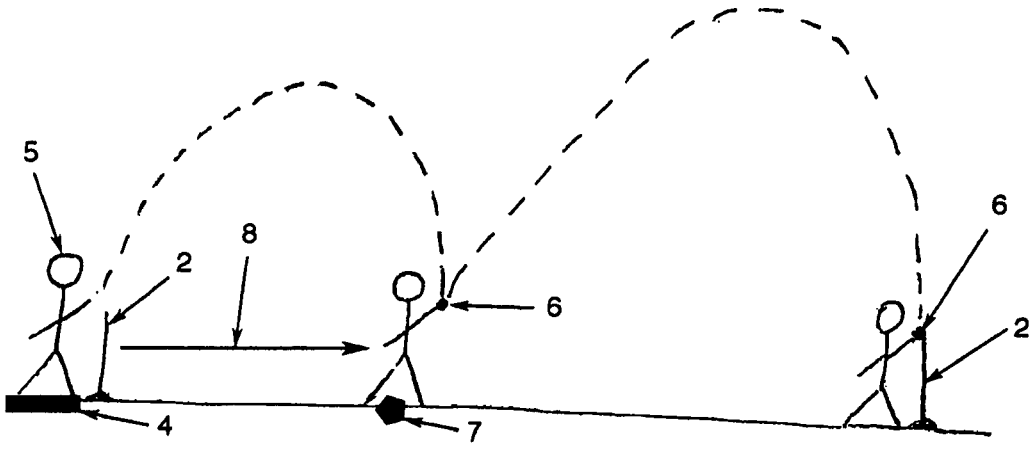
FIG. 2 is a side view of the course of play of the game of the invention.

The game consists of throwing and catching a ball 6 in order to advance the ball 6 from a starting mark 1 to a corresponding pylon 2. The object of the game is to complete a course of play 9 using the fewest number of catches possible. In one embodiment, the course of play 9 comprises an initial starting mark 1 and nine pylons 2, arranged in a form analogous to the tee-box and nine-hole combination known in the game of golf, which in the game of the invention are termed poles. The starting mark for play subsequent to the initial starting mark 1 can be either the pylon 2 of the previous pole, or a separate starting mark such as a starting mat 4. The course of play may be varied at the discretion of the players. A hypothetical course play 9 is illustrated in FIG. 1 and includes a starting mark 1, and a series of nine pylons 2A, 2B, 2C, 2D, 2E, 2F, 2G, 2H and 2J respectively, comprising the objective or finishing point for each of nine poles. The course of play can also include obstacles 3 to increase the difficulty of the game. An obstacle 3 may comprise a natural feature like a pond, planting or the like, or an artificial feature such as a building, or other object.

Each combination of starting mark and pylon is known as a pole, in the same manner as a "hole" in golf comprises the starting mark or tee box, and the hole. In addition to the starting mat 4 and pylons 2, each player has an object to throw and catch, which in the preferred embodiment comprises a ball 6. The precise dimension of the ball 6 is not critical to the play of the game, but the preferred ball would be one such as is used in the game of road hockey. Other objects suitable for throwing and catching, such as a baseball, softball, tennis ball, football, foam ball or beanbag could also be used, and are intended to be included in the invention disclosed. Throwing discs, such as Frisbee™ discs could also be used to play the game.

Any number of players may play the game at the same time, although for ease of play the preferred maximum number of players in a group is four. Where more than 1 player is involved in the game, all players must complete a pole before the group of players can continue to the next pole.

The game begins at the starting mark 1. Each player takes a turn by standing at a throw location and throwing his or her ball 6 into the air in the general direction of the first pylon 2, with the intention of being able to catch the ball before it hits the ground.

In one embodiment, it is required that at each pole after the first pole, the throw location to begin the next pole is behind and within touching distance of the pylon 2 of the prior pole. Touching distance is defined, as the distance within which a player can touch a pylon while keeping at least one foot fixed in place, much like the pivot foot concept of the game of basketball. Alternatively, a starting mat 4 placed on the ground near each pylon 2 could conveniently define the starting mark for each pole. A player would be required to have at least one foot touching the starting mat 2 when starting a new pole.

If the player successfully catches the ball 6, they then make their next throw from the location of the previous successful catch, and attempt to catch this next throw. If the player fails to catch the ball 6, they return to the location of the last successful catch for that pole and make another attempt. Players may dive through the air, or slide along the ground in order to make a successful catch. The catch location will be defined as the point on the ground where the player made the catch, such that progress towards a pylon 2 does not include any sliding, diving or running actions made after the ball has been caught.

Conveniently, the invention can also include a catch marker 7 to be used in marking the point of the last successful catch. When a successful catch is made, the player places the ball 6 at the point of the catch and then retrieves the catch marker 7. The catch marker 7 is then used to mark the point of the next attempt at a throw and catch. Alternatively the point of last successful catch can be estimated, so that the player does not have to back-track to retrieve the catch marker 7.

In order to complete a pole, the player must, after making a catch, be able to touch the pylon 2 with the ball 6 while keeping one foot at the spot where the catch was made. The score for each pole is the total number of throws required to complete the pole.

In another embodiment, a player who fails to make a catch before completing the pole, returns to the last completed pole to start that pole again. In this form of play a catch marker 7 is not required as the player simply makes the next throw from the point of a catch, and continues until the pole is successfully completed, or returns to the last pole to again attempt to complete the next pole.

In order to have play proceed efficiently where more than one player is playing the game, one order of play is to have the player farthest away from the pole take the next turn. This is analogous to the order of play in the game of golf where the furthest player from the hole is next to play. Another order of play is to have one player play a pole until completion, after which the next player does the same, until all players in the game have completed the pole. Under this method of play, all players would complete a pole before proceeding to the next pole in the sequence.

The game is complete once all players have completed all poles successfully. A player's score for the game is the total number of throws taken in order to complete the course. Score-keeping devices such as counters, score sheets and the like may also be conveniently included with the game to simplify the process of keeping score during the course of play.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A method of playing a throwing and catching game comprising:

providing a course comprising a plurality of poles having a length, each pole comprising a starting mark and a pylon separated by a pole length, wherein the poles are arranged sequentially such that a player can conveniently move from one pole to the starting mark of the next pole;

providing a throwing object, and wherein a turn comprises standing at a throw location and throwing the throwing object towards the pylon corresponding to the pole being played, and a successful turn comprises moving to a catch location and catching the throwing object before the throwing object contacts the ground, and an unsuccessful turn comprises moving to the catch location and failing to catch the throwing object before the throwing object contacts the ground;

playing each pole sequentially by standing at a first throw location corresponding to a starting mark for the pole, and taking successive turns and wherein for a successful turn the throw location for the next turn corresponds to the catch location of the successful previous turn, and wherein for an unsuccessful turn the throw location for the next turn corresponds to one of the throw location of the unsuccessful previous turn and the starting mark of the pole being played;

wherein a pole is completed when a player located at the catch location of a successful turn is able to touch the pylon of the pole being played, and a score for the completed pole comprises the number of throws taken to complete the pole being played; and adding the scores for each pole to obtain a total score.

2. The method of claim 1 wherein the starting mark of at least one pole is provided by the pylon of the previous pole.

3. The method of claim 1 wherein the starting mark of at least one pole is provided by a starting marker.

4. The method of claim 1 wherein a pole is completed when a player located at the catch location of a successful turn is able to hold the throwing object and touch the pylon of the pole being played with the throwing object.

5. The method of claim 1 where in the throwing object is one of a baseball, softball, tennis ball, football, foam ball, beanbag, and throwing disc.

6. The method of claim 1 comprising marking a throw location with a catch marker such that, should the turn be unsuccessful, the player can accurately return to the throw location of the unsuccessful turn.

7. The method of claim 1 comprising estimating the position of a throw location such that, should the turn be unsuccessful, the player can return to approximately the throw location of the unsuccessful turn.

8. The method of claim 1 wherein a plurality of players play at the same time.

9. The method of claim 8 wherein the players take alternate turns with the player whose current throwing location is farthest from the pylon playing first.

* * * * *